US005582854A

United States Patent [19]

Nosaka et al.

[11] Patent Number: 5,582,854

[45] Date of Patent: Dec. 10, 1996

[54] COOKING WITH THE USE OF MICROWAVE

[75] Inventors: Chiaki Nosaka; Tomoaki Hisatsuka, both of Kawasaki, Japan

[73] Assignee: Ajinomoto Co., Inc., Tokyo, Japan

[21] Appl. No.: 267,615

[22] Filed: Jun. 29, 1994

[30] Foreign Application Priority Data

| | | | |
|---|---|---|---|
| Jul. 5, 1993 | [JP] | Japan | 5-165513 |
| Jul. 5, 1993 | [JP] | Japan | 5-165514 |
| Mar. 23, 1994 | [JP] | Japan | 6-052025 |

[51] Int. Cl.[6] ..... H05B 6/00

[52] U.S. Cl. ..... 426/234; 426/241

[58] Field of Search ..... 426/234, 107, 426/113, 241, 243; 219/728, 730, 748

[56] References Cited

U.S. PATENT DOCUMENTS

| | | | |
|---|---|---|---|
| 2,576,862 | 11/1951 | Smith et al. | 426/241 |
| 4,992,636 | 2/1991 | Namiki et al. | 426/234 |
| 5,322,984 | 6/1994 | Habeger, Jr. et al. | 426/234 |

*Primary Examiner*—George Yeung

*Attorney, Agent, or Firm*—Oblon, Spivak, McClelland, Maier & Neustadt, P.C.

[57] ABSTRACT

A method and apparatus of preparing heat-gelled foods, dried instant foods together with water added thereto, and liquid food, using microwaves, wherein the food to be prepared by microwave heating is placed in a vessel and at least one protrusion is arranged in the vessel. The protrusion is made of a material having a function of collecting microwaves and upon subjection to microwaves collects the microwaves and results in uniform heating of the food placed in the vessel.

5 Claims, 15 Drawing Sheets

FIG. 1A
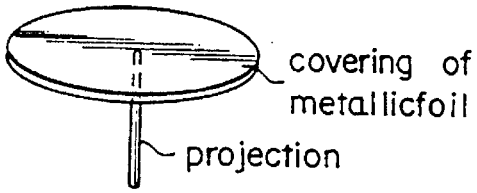
FIG. 1B
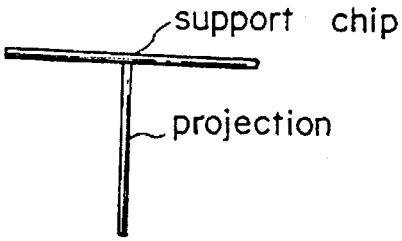
FIG. 1C
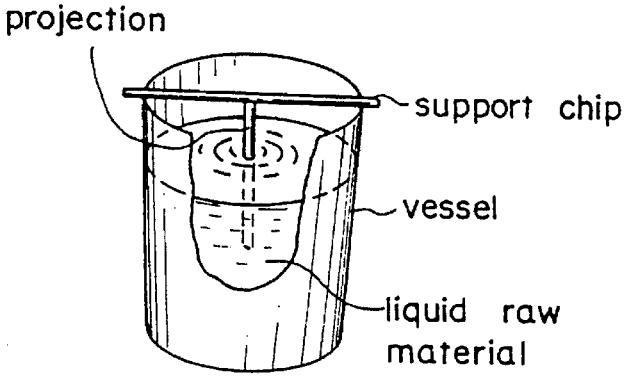
FIG. 1D
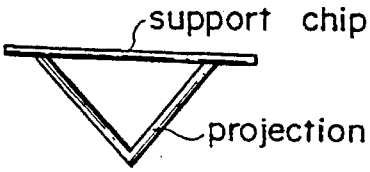
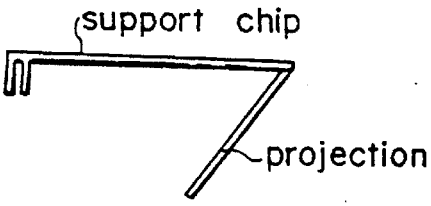
FIG. 1E
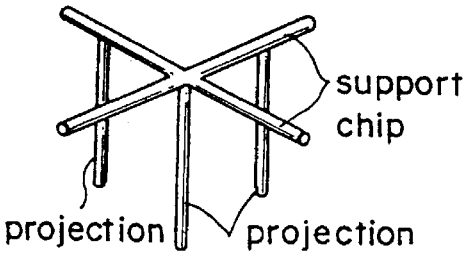
FIG. 1F

TEMPERATURE UNEVENNESS RESULTING IN MICROWAVE OVEN HEATING IN WARMING SAKE

TEMPERATURE UNEVENNESS RESULTING IN MICROWAVE OVEN HEATING FOR MILK

TEMPERATURE UNEVENNESS RESULTING IN MICROWAVE OVEN HEATING FOR SOUP

COOKING WITH THE USE OF MICROWAVE

BACKGROUND OF THE INVENTION

1. Field of the Invention

The present invention relates to cooking with the use of microwave, and more particularly to a method of heat-gelled foods, dried instant foods and cooking thereof, liquid foods and heating thereof, and heating tools for a microwave oven.

2. Discussion of the Background

Recently, microwave ovens both for commercial and domestic uses are popularized and utilized for convenient cooking as cooking devices wherein heating can be done for a short time.

Therefore, also in cooking for foods to be gelled by heating such as Japanese food chawanmushi, Japanese food odamakimushi, pudding, Japanese food tamagodofu and the like, the microwave oven heating has been utilized in place of heating by means of the conventional steam heating or the like.

However, even though it being said as microwave oven heating, if a steam cup (mushi-jawan) which has been filled with the raw material containing egg prior to gelation (referred to as "egg liquid" in this specification) is covered with a lid, placed in a microwave oven, and heated desultorily, there is a tendency to produce so-called honeycomb hollows on the surface of the gelled egg liquid because of localized overheating on the surface layer of the egg liquid. Thus, in order to prevent it, it is known that the surface of an egg liquid is covered with an aluminum foil to prevent the localized overheating of the egg liquid and make the whole egg liquid to be heated uniformly as possible, and then it is heated in a microwave oven. In this case, it may be carried out to introduce water around the cup.

However, as to the said method wherein the aluminum foil or the aluminum foil with holes is used to prevent localized overheating and make the whole egg liquid to be heated uniformly as possible and prevent production of the honeycomb hollows, it can be realized in a low-power domestic use microwave oven with an output of about 500–600 W for a prolonged time, but in the case of a high-power commercial use microwave oven with an output up to 1400–1600 W, honeycomb hollows and uniform heating of the egg liquid in the vessel are caused owing to partly insufficient heating (particularly, at the center of the surface) or overheating (around the surface) resulting from temperature increase for a very short time.

Therefore, it is required to develop an effective method of heating evenly and uniformly when gelled foods are prepared by heating in the microwave oven, particularly in the commercial use microwave oven.

Under the above-mentioned technical background, it is an object of the present invention to provide an uniform heating method for effective prevention of honeycomb hollow occurrence, when the gelled foods are produced by gelling the liquid raw material by means of microwave heating, particularly commercial use microwave heating.

As has been described above, recently, microwave ovens both for commercial and domestic uses have been popularized and utilized in convenient cooking as cooking devices capable of heating foods in a short period of time.

And, as a way of such utilization, it is considered to cook them by placing a dried instant food such as dried instant noodle, dried porridge, dried powdery miso soup, dried soup or dried red-beam soup (they may of course be packed in a cup like cup noodle or cup soup), together with water in a vessel, apply stirring if necessary (particularly in a case of powdery foods), and heating them with a microwave oven. This procedure is much convenient since a step of separately boiling water can be saved.

However, in a case of actually cooking a dried instant food in a microwave oven, since the contents in the vessel are difficult to be heated uniformly and it is often experienced that the upper part of the contents has been already well cooked by being heated to such an extend as suitable to eat but the part at the bottom of the vessel has not yet been heated sufficiently and reversion of the dried instant food is insufficient. Further, in a case of powdery soup containing a proteinous raw material, if it is placed in a cup, added with water and warmed in a microwave oven, it is often experienced as well that, due to localized overheating of the surface, heat-coagulated membranes of protein are formed on the surface of the liquid contents, or the contents deposit on portions adjacent to the vessel wall.

As has been described above, cooking of dried instant foods by using the microwave oven can provide a merit of allowing convenient cooking but entails a problem that uniform heating is difficult or causing localized overheating.

Under the above-mentioned technical background, it is another object of the present invention to provide means capable of uniformly heating the contents in a vessel and means capable of effectively preventing localized overheating upon heat-cooking of dried instant foods together with water in a microwave oven.

Again, as has been described above, recently, microwave ovens both for commercial and domestic uses have been popularized and utilized in convenient cooking as cooking devices capable of heating foods in a short period of time.

Such a way of utilization includes, for example, warming Japanese sake contained in a sake bottle (tokkuri) with a microwave oven or warming milk filled in a cup with a microwave oven into hot milk.

However, in a case of heating with a microwave oven it is often experienced that such a situation in which the lower part of the liquid contained in a vessel is not yet heated sufficiently and tepid although the upper part thereof has been sufficiently heated to an appropriate temperature or, on the contrary, the upper part becomes too hot when the lower part is heated to a moderate temperature, failing to attain uniform heating. In addition, if such foods not heated uniformly are taken as they are, it is extremely uncomfortable, for example, in that milk which is initially at a moderate temperature gradually becomes tapid and, further, turns cold.

Further, if the sake bottle is warmed by using a microwave oven, sudden boiling is often caused due to the overheating of the surface part. Sudden boiling deteriorates the sake in taste and, further contaminates the inside of the microwave oven as well. Furthermore, when milk contained in a cup is warmed with a microwave oven, it is often experienced that membranes caused by heat-coagulation of protein are formed on the surface of the milk, or heat-coagulation products of the protein deposit on portions of the surface in contact with the cup wall, owing to the overheating of the surface part.

As described above, when liquid foods are heated with a microwave oven, it is difficult to uniformly heat them to a moderate temperature, which sometimes results in a problem, for example, sudden boiling or deposition of heat-coagulation products due to a not-uniform heating or localized overheating.

Under the above-mentioned technical background, it is a third object of the present invention to provide means capable of uniformly heating liquid foods to a moderate temperature and effectively preventing sudden boiling or deposition of heat-coagulation products caused by localized overheating upon heating the liquid foods with a microwave oven, as well as liquid foods packed in a vessel equipped with such means for microwave heating.

Under the above-mentioned technical background, finally, it is an object of the present invention to provide uniform heating tools for effective prevention of honeycomb hollows, when gelled foods are to be produced by gelling a liquid raw material by means of microwave heating, particularly, by using a commercial use microwave heating, tools capable of uniformly heating the contents in a vessel and effectively preventing localized overheating upon heat-cooking of dried instant foods together with water in a microwave oven, and tools capable of uniformly heating liquid foods to a moderate temperature and effectively preventing sudden boiling or deposition of heat-coagulation products caused by localized overheating upon heating the liquid foods with a microwave oven.

SUMMARY OF THE INVENTION

In an aspect of the present invention, there are provided improvements in a method of preparing gelled foods by heating a liquid raw material to be gelled in a microwave oven to gel the same.

In another aspect of the present invention, there are provided dried instant foods suitable for microwave cooking and a method of cooking the same by using a microwave oven.

In a third aspect of the present invention, there are provided a method of heating liquid foods by using a microwave oven and liquid foods contained in a vessel suitable for heating with a microwave oven.

And, in a fourth aspect of the present invention, there are provided tools to be used for preventing local overheating and/or promoting uniform heating upon (cooking) heating by using a microwave oven.

BRIEF DESCRIPTION OF THE DRAWINGS

FIGS. 1–8 show some examples of heating tools for a microwave oven and how to use.

DETAILED DESCRIPTION OF THE INVENTION

Figure 2A:
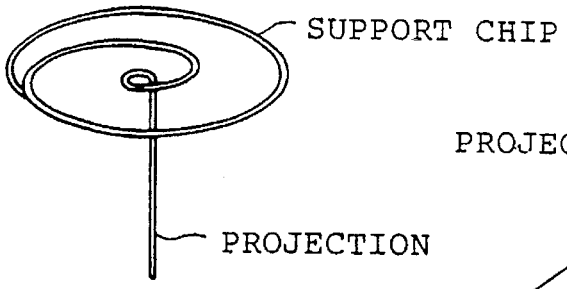
Figure 2B:
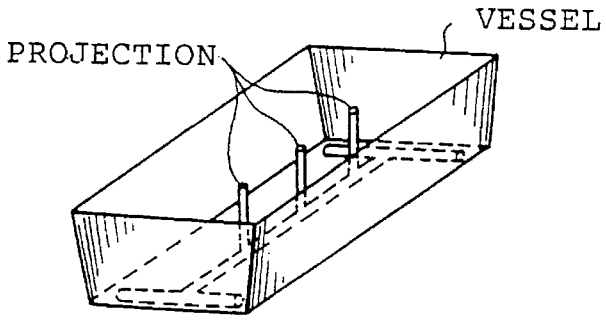
Figure 2C:
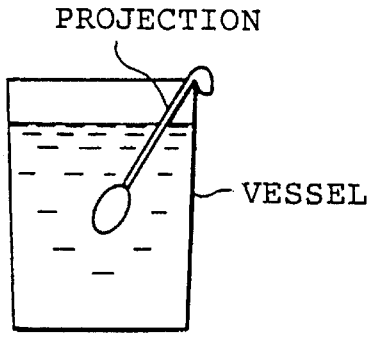
Figure 2D:
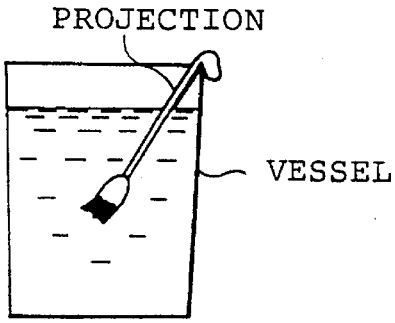

With respect to the object first-mentioned above, the inventors have studied in earnest to attain the above-mentioned and other objects and found that even though in the case of a commercial use microwave oven being used, occurrences of honeycomb hollows may be prevented easily and uniform heating may be realized by covering the surface of a liquid raw material placed in a vessel with a covering made of material having a microwave blocking function and arranging like an antenna, at least one projection made of material having a function to collect microwave such as metal projection or the like on the central part of the surface area or vicinity thereof followed by heating the whole in the microwave oven and made the present invention on these findings.

Thus, the invention relates to a method of preparing heat-gelled foods by heating a liquid raw material to be gelled in a microwave oven to gel it, characterized in that the surface of said liquid raw material placed in a vessel is covered with a covering made of material having a microwave blocking function and at least one projection made of material having a function to collect microwave on the central part of the surface area or vicinity thereof is arranged like an antenna, followed by heating the whole in the microwave oven, whereby the raw material may be prevented from being overheated locally and may be heated uniformly through the whole.

The invention is illustrated in detail as follows.

As the gelled foods to be produced according to the invention, there are typically mentioned the followings including, but not limited to, gelled foods such as the above-mentioned chawanmushi, odamakimushi, pudding, tamagodofu and the like, which are the gelled foods prepared by utilizing thermal coagulation property of egg (herein, egg includes any of whole egg, the yellow, the white and the like.) as well as mousse and terrine prepared from minced fish meat and any other gelled foods prepared by heat-gelling.

For example, in the case of the egg processed foods, the liquid raw materials are liquid raw materials prior to heat-gelation, and especially in the case of chawanmushi, they are those obtained by mixing and stirring whole egg with seasoning liquid and optionally adding some appropriate ingredients if desired. Egg concentration of an egg liquid is not specially limited as long as it is gelled. Though, the invention has no characteristics as to the raw material egg liquid itself, so that it may be in accordance with any known recipe. Also, in the case of marine product mousse, the liquid raw material is that obtained by adding so-called thickenings such as starch, the white and the like, and optionally seasonings, to minced white flesh, scallop, and the like to make a paste-like one. To the liquid raw material, solid ingredients may be added if desired.

There is no limitation as to the microwave oven, and both high-power commercial and low-power domestic use ones can be used, though in the former case the effect of the invention (prevention of honeycomb hollow occurrence and uniform heating) may be markedly realized but the latter case is of course included in the scope of the invention, too.

Of course, the vessel for containing the liquid raw material must be resistant to heating in the microwave oven. In the case of chawanmushi, a conventional porcelain steaming cup with a lid can be used as such, which is being conveniently used when chawanmushi is prepared by heating with heated steam.

The covering may be anyone provided that it has the effect of blocking microwave, for example, metallic foils such as aluminum foil and stainless steel foil. In other words, its form need not be necessarily the so-called foil form and it may be the so-called plate form and others, as well as its material may be other than metal provided that it has the similar effect. It is to cover the surface of the liquid raw material to block microwave from above to some extent, and acts in order to prevent honeycomb hollow occurrence on the surface caused by localized overheating of the liquid raw material surface layer.

As to the design of the covering to develop said action effectively, for example, the effect can be obtained only by covering the whole opening of the vessel in the case of a steaming cup, but the preferred effect can be obtained by the design to cover the outer side wall part of the vessel from the top up to the position or slightly above the position of the liquid surface, holes may be arranged through the covering. It may be disposable.

It has been already known that a nail- or conical-form projection or stick made of metal such as stainless steel or the like has a function of collecting microwave. It has not yet been known, however, to utilize such phenomenon for uniform heating of the whole liquid raw material with the use of a microwave oven. The inventors have succeeded in uniform heating of the whole liquid raw material, by utilizing the phenomenon and preventing localized overheating during the preparation of gelled foods by means of heating.

Thus, the number, material, size, form, and the like of the antenna-like projection is not particularly limited provided that it shows the phenomenon and results in uniform heating, but preferably it is better made to be as fine as possible in order not to collapse the form of the gelled product when removed. The antenna-form projection may also be made as the disposable type.

To arrange the projection relative to the liquid raw material contained in a vessel, there is no particular limitation on the arrangement provided that it is an arrangement appropriate to heat the liquid raw material uniformly. In this connection, "heating uniformly" used in connection with the invention has a concept including of course the case wherein heating is substantially uniform as well as all cases wherein heating becomes more uniform compared to the case without using such projection under the same conditions except for it.

The projection of the material having a function to collect microwave may be arranged as follows, for the purpose of the arrangement. That is, the antenna-form projection is arranged at the central part of the liquid raw material surface or the vicinity thereof, namely the part which is difficultly heated compared to the outer peripheral part. In order to carry out such arrangement, for example, the projection is arranged relative to the liquid raw material in such a way that the tip of the projection is dipped in the liquid raw material at the central part of the liquid raw material or the vicinity thereof. The tip of the projection need not be necessarily dipped in the raw material provided that the similar effect may be obtained, and it may be on or a little over the surface. Moreover, for example, the projection to be arranged like an antenna may be arranged upward from the bottom of the vessel. See FIG. 2(*b*). In this case, the tip of the projection may be dipped in the material or projected from the raw material surface. Also, the projection can be arranged from the inside wall of the vessel into the central part, as the case may be (see FIG. 1(*e*)). To sum up, the tip of the antenna-type projection should be arranged at the place in which the liquid raw material is difficultly heated.

Additionally, a covering to block microwave and a projection having the function of collecting microwave are, as described above, to prevent localized overheating of the raw material contained in the vessel and heat the liquid raw material uniformly. From such viewpoints, the projection to be arranged like an antenna is suitably arranged, for example, as follows concretely.

That is, as to the arranging way, firstly it is arranged while bound to the covering as shown in FIG. 1(*a*). For it, a covering of metallic foil and a projection can be made integratedly, or a projection may be adhered to a covering of metallic foil by means of soldering or adhering with suitable adhesives. The projection may be spontaneously arranged in the suitable position by covering the surface of the liquid raw material with the covering. Moreover, it may arranged irrelevant to a covering of metallic foil as shown in FIG. 1(*b*)–(*f*) and FIG. 2(*a*) and (*b*). FIG. 1(*b*) shows an embodiment wherein a projection is being adhered at right angles to a bar-type support chip made of any suitable material and the projection is arranged in a suitable position by hanging the support chip on the edge of the vessel in such a way that the tip of the projection is dipped in the liquid raw material. FIG. 1(*c*) shows such an arrangement. FIG. 1(*d*) shows an embodiment wherein a projection with a reverse triangle form is adhered to a support chip. FIG. 1(*e*) shows a construction wherein the tip of a support chip can be hung on the edge of a vessel (the left end of the support chip is made to place the edge of the vessel between), and the projection is arranged from the side wall of the vessel against the central part of the liquid raw material. FIG. 1(*f*) shows an embodiment wherein two bar-type support chips are crossed to form a support chip, and total three projections are adhered to the support chip. FIG. 2(*a*) shows an embodiment wherein the support chip is a whirlpool form. FIG. 2(*b*) shows an example wherein (three) projections are arranged upward from the bottom of a vessel. In these cases, the support chip and the projection can of course be made by molding integratedly depending on the materials.

Microwave oven heating is carried out until the whole liquid raw material has been heated to a temperature where uniform gelation is caused (acceptable cooking temperature range). Those skilled in the art can easily determine such appropriate heating conditions (output, heating time and the like) by their prior experiences or pre-trials. In this connection, the acceptable cooking temperature range is from about 80° to 90° C. in the preparation of the egg processed foods by utilizing thermal coagulation of eggs.

When the temperature of an egg liquid becomes above the temperature range locally or wholly to produce honeycomb hollows, it is overheating.

With respect to the object second-mentioned above, the present inventors have made an earnest study for attaining the foregoing and other objects, and as a result, found that those objects can be attained, in the case where a dried instant food placed, together with water, in a vessel is cooked in a microwave oven, by arranging protrusion(s) made of a material having a function of collecting microwave. They have accomplished the present invention based on the findings described above.

A first embodiment of the present invention concerns a method of cooking dried instant foods contained, together with water, in a vessel with the use of a microwave oven, characterized in that protrusion(s) made of a material having a function of collecting microwave are arranged so that the contents in the vessel are heated uniformly.

Descriptions will now be made more specifically to the present invention.

There is no particular restriction on a microwave oven to be used in the method of the present invention, and it may be a low-power domestic use microwave oven with an output of about 500–600 W or a high-power commercial use microwave oven with an output amounting to 1400–1600 W.

Where is also no particular restriction on the dried instant foods to be heat-cooked by the method of the present invention provided that they are added with water and cooked by heating. Specifically there can be mentioned, for example, dried instant noodles, dried porridge, dried powdery miso soup, dried soup, dried red-bean soup and the like, as has been named above. The instant foods can also be those packed in a cup like a cup noodle, cup soup or the like, as has been described previously.

It is apparent that a vessel to contain a dried instant food has to be resistant to heating with a microwave oven. In view of the above, a ceramic cup may be used. Further, if a dried instant food is packed in a cup and the cup is resistant to heating with a microwave oven, it can of course be utilized as it is as a vessel used in the present invention.

Now, one of the most prominent features of the present invention lies in that protrusion(s) made of a material having a function of collecting microwave is arranged, relative to the contents in the vessel when a dried instant food is contained in a vessel and added with water and heat-cooked in a microwave oven. Description will now be made thereabout.

It has been already known, as has been described above, that a nail- or conical-form projection, protrusion or stick made of a metal such as stainless steel or the like, has a function of collecting microwave. It has not yet been known, however, to utilize such a phenomenon for uniform heating of the entire contents in the vessel when dried instant food is, together with water, contained in a vessel and heat-cooked with a microwave oven. The inventors skillfully solved the problem of not-uniform heating and localized overheating caused upon heating with a microwave oven by utilizing the phenomenon.

Thus, there is no particular restriction, for example, on the number, material, size, form and the like, of such protrusion(s) made of a material having a function of collecting microwave and to be arranged in relation with the dried instant food contained together with water in a vessel, provided that the material results in the foregoing phenomenon and uniform heating. The protrusion may be made disposable.

To arrange the projection(s) relative to dried instant food contained together with water in a vessel, there is no particular restriction, provided that they are arranged such that the contents in the vessel are heated uniformly. In this connection, since it is naturally impossible to heat the entire contents in the vessel completely uniformly with a microwave oven, "heating uniformly" used herein has a concept including a case in which heating is applied substantially uniformly, as well as all other cases in which heating becomes more uniform when applied under the same conditions, except for using the protrusion(s), as compared with the case without using such protrusion(s).

Projection(s) of material having a function of collecting microwave may be arranged as follows, for the purpose of the arrangement. That is, such projections are arranged at the central part of the surface layer of the contents in the vessel or the vicinity thereof, namely, at a part which is more difficult to be heated as compared with the outer peripheral part.

In order to carry out such arrangement, a protrusion is arranged, for example, on the surface of the contents in the vessel in such a way that the tip of the protrusion is dipped in the water of the contents in the vessel at the central part of the surface of the contents in the vessel or the vicinity thereof. The tip of the projection need not be necessarily dipped in the water, provided that a similar effect may be obtained, and it may be on, or floated a little over, the surface. Moreover, projections may be arranged, for example, upward from the bottom of the vessel (see FIG. 2(*b*)). In this case, the tip of the projection may be preferably dipped in the water of the contents in the vessel but it may be in a not-dipped state. Also, the projection can be arranged from the inside wall of the vessel to the central part of the contents in the vessel depending on the case (see FIG. 1(*e*)). In this case, it will be convenient to fabricate the protrusion in the shape of a fork (refer to FIG. 2(*d*)), spoon (FIG. 2(*c*)) or stirrer since it can be used as it is in the case of taking, drinking or stirring the food after cooking by microwave oven heating, as a fork, spoon or stirrer. In short, a protrusion made of a material having a function of collecting microwave is preferably arranged such that the tip thereof is situated at a place in which the contents in the vessel are difficult to be heated.

Additionally, projections having a function of collecting microwave are used for preventing localized over-heating of the contents in the vessel and heating the entire contents in the vessel uniformly as described above. From such viewpoints, projections are suitably arranged, concretely, for example, as shown in FIG. 1(*b*)–(*f*), and FIG. 2(*a*)–(*d*). FIG. 1(*b*) shows an embodiment wherein the projection is adhered at a right angle to a bar-shaped support chip made of any suitable material and the protrusion is arranged in any suitable position by hanging the support chip on the edge of the vessel in such a way that the tip of the projection is dipped in the water of the contents in the vessel. FIG. 1(*c*) shows a state arranged in this way. FIG. 1(*d*) shows an embodiment wherein the projection of a reversed triangle form is adhered to a support chip, FIG. 1(*e*) shows an embodiment of such a structure in which one end of the support chip can be hung on the edge of the vessel (the left end of the support chip is made to place the edge of the vessel therebetween), and the projection is arranged from the side wall of the vessel to the central part of the contents in the vessel. FIG. 1(*f*) shows an embodiment of a support chip wherein two bars are crossed, and (three) projections are adhered to the support chips. FIG. 2(*a*) shows an embodiment wherein a support chip is in a spiral form, FIG. 2(*b*) shows an embodiment wherein (three) projections are arranged from the bottom of a vessel to the upper part, and FIG. 2(*d*) shows an embodiment wherein a protrusion in the form of a fork is arranged. In these cases, the support chip and the projection can naturally be made by integral molding depending on the materials.

Those skilled in the art can easily determine, from their past experience or pre-trial, operational conditions for a microwave oven such as output, heating time and the like upon heat-cooking a dried instant food by heating with the microwave oven, after placing the food together with water in a vessel, stirring them if necessary (for example, in a case, particularly, of powdery dried instant foods) and arranging protrusions made of a material having a function of collecting microwave so that the entire contents in the vessel are heated uniformly.

In a case where the dried instant foods contain a proteinous ingredient such as skim milk and when they are added with water and heated, as has been described, formation of membranes of heat-coagulated protein on the surface of the liquid contents, and deposition of the contents on the portion adjacent to the vessel wall are often caused, as has been described. In order to prevent such disadvantage, a lid or covering made of a material for blocking microwave is preferably disposed on the edge of the vessel in carrying out the cooking method according to the present invention.

Figure 3A:
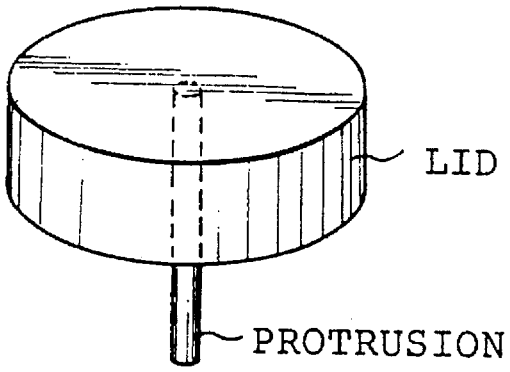
Figure 3B:
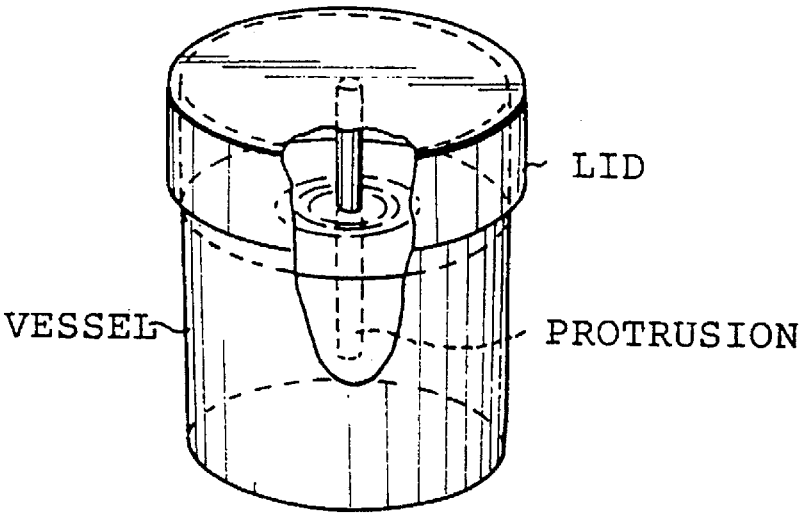
Figure 4A:
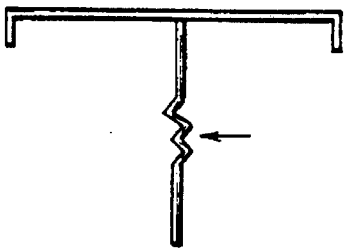
Figure 4B:
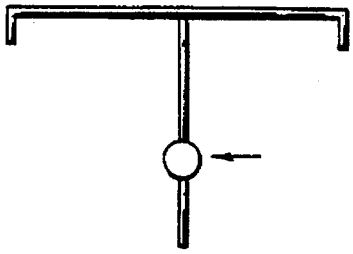
Figure 4C:
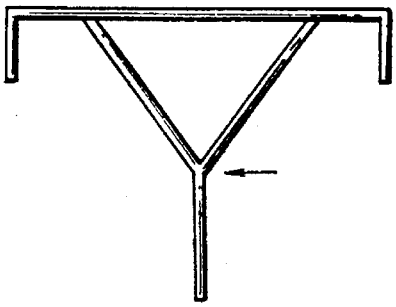
Figure 4D:
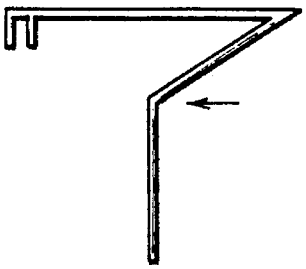

The lid can be made of any material provided that it has a function of blocking microwave, including metallic foils such as aluminum foils, stainless steel foils and the like. Further, if a semi-transparent metallic foil or the like having fine apertures disposed therethrough but not permeating microwave is used, the contents can easily be observed from the outside of the lid. The lid may be of such a shape that it covers the edge of the vessel to prevent deposition of heat-coagulation products on the vessel wall caused by overheating, for example, as shown in FIG. 3(*a*). FIG. 3(*b*) shows a state in which it is disposed on the edge of the vessel. Since there is no limit on the shape of such lid and it may suffice to be a shape of covering at least the peripheral portion, the central portion may or may not be opened.

A second embodiment of the present invention concerns dried instant foods packed in a vessel utilizing the feature of the present invention described above and, more in particular, it relates to dried instant foods packed in a vessel to be added with water and heat-cooked with a microwave, characterized in that protrusion(s) made of a material having a function of collecting microwave is (are) arranged or can be arranged relative to the contents so that the entire contents may be heated uniformly.

As has been described above, dried instant foods packed in a cup such as cup noodle and cup soup have already been well-known, also including their production processes. Such dried instant foods packed in a vessel of the present invention can be produced in accordance with well-known production processes except for protrusions made of a material having a function of collecting microwave.

The protrusions constituting one of the features of the present invention may be integrally molded with a vessel if possible, or may be appended to dried instant foods packed in a vessel when they are put on a circulation market.

As for the dried instant foods packed in a vessel of the present invention, a lid or covering made of a material for blocking microwave is of course disposed on the edge of the vessel for the same reasons and for the same purposes as those described for the first embodiment of the present invention. The lid may also be disposed in a state being secured to the cover of the vessel for the dried instant foods packed in the vessel, may be integrated with the protrusion (FIG. 3(*a*)), or may be appended to the dried instant foods packed in a vessel when they are put on a circulation market.

With respect to the object third-mentioned above, the present inventors have made an earnest study for attaining the foregoing and other objects, and as a result, found that those objects can be attained in the case where a liquid food contained, together with water, in a vessel is cooked by microwave oven heating, by disposing protrusion(s) made of a material having a function of collecting microwave relative to the liquid and further disposing a lid made of a material for blocking microwave on the edge of the vessel. They have accomplished the present invention based on these findings.

Specifically, a first embodiment of the present invention concerns a method of heating a liquid food which comprises placing a liquid food and in a vessel, and subjecting the liquid food to microwave oven heating, with protrusion(s) made of a material having a function of collecting microwave being arranged so that localized overheating is prevented to effect uniform heating.

There is no particular restriction on a microwave oven to be used in the method of the present invention, and it may be a low-power domestic use microwave oven with an output of about 500–600 W or a high-power commercial use microwave oven with an output amounting to about 1400–1600 W.

There is also no particular restriction on the liquid foods to be heated by the method of the present invention, and they include milk and Japanese sake, described previously, or like other foods that involve similar problems upon heating, for example, potage and other soups, sauces, red-bean soup, miso soup and soups for noodles. Liquid foods such as curry roux, stew, glatin, meat sauce and other liquid foods containing solid components are also included. Further, those foods are also included in which liquid foods are to be heated in combination with rice, noodle, pasta or the like with a microwave oven, such as curry and rice, Chinese noodle, Japanese udon and the like. For instance, even with respect to liquid foods of high viscosity, for example, potage soup, stew and the like, temperature differences caused upon heating in the microwave oven can be avoided according to the present invention.

It will be apparent that a vessel to contain a liquid food has to be resistant to heating with a microwave oven. In view of the above, a porcelain cup or porcelain sake bottle may be used, but vessels are not particularly restricted thereto.

Now, one of the most prominent features of the present invention lies in that protrusion(s) made of a material having a function of collecting microwave are arranged with relation to the liquid foods to be heated when they are heated with a microwave oven. Description will now be made more specifically thereabout.

Now, it has been already known, as has been described above, that a nail- or conical-form projection made of a metal such as stainless steel has a function of collecting microwave. It has not yet been known, however, to utilize such a phenomenon for uniform heating of the entire liquid food in a vessel, when a liquid food is heated with a microwave oven. The present inventors skillfully solved the problem of not-uniform heating or localized overheating upon heating with a microwave oven by utilizing the phenomenon.

Thus, there is no particular restriction, for example, on the number, material, size, form and the like of such protrusion(s) made of a material having a function of collecting microwave and to be arranged in relation with the liquid foods provided that they result in the foregoing phenomenon and uniform heating. Such protrusions may be made disposable.

To arrange the projection(s) relative to the liquid food contained in a vessel, there is no particular restriction, provided that they are arranged such that the liquid food can be heated uniformly. In this connection, since it is naturally impossible to heat the entire liquid food completely uniformly with a microwave oven, "heating uniformly" used herein has a concept including a case in which heating is applied substantially uniformly, as well as all other cases in which heating becomes more uniform when applied under the same conditions except for using the protrusion(s), as compared with the case without using such protrusion(s).

The projection(s) of material having a function of collecting microwave may be arranged as follows, for the purpose of the arrangement. That is, such projections are arranged at the central part of the liquid food surface or in the vicinity thereof, namely, at a part which is more difficult to be heated as compared with the outer peripheral part.

In order to carry out such arrangement, a protrusion is arranged, for example, on the surface of the liquid food in such a way that the tip of the protrusion is dipped in the liquid food at the central part of the liquid food surface or in the vicinity thereof. The tip of the projection need not be necessarily dipped in the liquid, provided that a similar effect may be obtained, and it may be on, or floated a little over the surface. Moreover, the projection may, for example, be arranged upward from the bottom of the vessel (in this case, the tip of the projection may be preferably dipped in the liquid but may be in a not-dipped state). Also, the projection can be arranged from the side wall of the vessel to the central part depending on the case. In this case, it will be convenient to fabricate the protrusion in the shape of a spoon (see FIG. 2(*c*)) or a stirrer since it can be used as it is in the case of stirring the liquid food after cooked by microwave oven heating. In short, protrusions made of material having a function of collecting microwave are preferably arranged such that the tips thereof are situated at a place of the liquid food difficult to be heated. Since arrangement can be determined easily by previous trial by those skilled in the art.

Additionally, projections having a function of collecting microwave are used for preventing localized overheating of the liquid contained in a vessel and heating the entire liquid food uniformly as described above. From such viewpoints, projection are suitably arranged, concretely, for example, as shown in FIG. 1(*b*)–(*f*) and FIG. 2(*a*)–(*d*). FIG. 1(*b*) shows an embodiment wherein a projection is adhered at a right angle to a bar-shaped support chip made of any suitable material and the protrusion is arranged in any suitable position by hanging the support chip on an edge of the vessel in such a way that the tip of the projection is dipped in the liquid. FIG. 1(*c*) shows a state arranged in this way. FIG. 1(*d*) shows an embodiment wherein a projection of a reversed triangle form is adhered to a support chip, FIG. 1(*e*) shows an embodiment of such a structure in which one end of the support chip can be hung on the edge of the vessel (the left end of the support chip is made to place the edge of the vessel therebetween), and the projection is arranged from the side wall of the vessel to the central part of the contents in the vessel. FIG. 1(*f*) shows an embodiment of a support chip wherein two bars are crossed, and (three) projections are adhered to the support chips. FIG. 2(*a*) shows an embodiment wherein a support chip is in a spiral form, FIG. 2(*b*) shows an embodiment wherein (three) projections are arranged from the bottom of a vessel to the upper part, and FIG. 2(*d*) shows an embodiment wherein a protrusion in the form of a fork is arranged. In these cases, the support chip and the projection can naturally be made by integral molding depending on the materials.

Those skilled in the art can easily determine, from their past experience or pre-trial, operational conditions for a microwave oven such as output, heating time and the like upon heating a liquid food with a microwave oven, after placing the food in a vessel, and arranging protrusion(s) made of a material having a function of collecting microwave so that localized overheating is prevented to effect uniform heating.

In carrying out the method of the present invention, a lid or covering made of a material for blocking the microwave is preferably disposed on the edge of the vessel, in order to prevent deposition of heat-coagulated products on the vessel wall caused by overheating as described above more easily and more completely, which is observed upon heating such proteinous liquid food as milk with a microwave oven.

The lid can be made of any material provided that it has a function of blocking microwave, including metallic foils such as aluminum foil, stainless steel foil and the like. Further, if a semi-transparent metallic foil or the like having fine apertures disposed therethrough but not permeating microwave is used, the contents can be easily confirmed from the outside of the lid. The lid may be of such a shape that it covers the edge of the vessel to prevent deposition of heat-coagulation products on the vessel wall caused by overheating, for example, as shown in FIG. 3(*a*). FIG. 3(*b*) shows a state in which it is disposed on the edge of the vessel. Since there is no restriction on the shape of such a lid and it may suffice to be a shape of covering at least the peripheral portion, the central portion may or may not be opened.

A second embodiment of the present invention concerns liquid foods packed in a vessel for microwave oven heating utilizing the feature of the present invention described above and, more in particular, it relates to liquid foods packed in a vessel for microwave oven heating in which protrusion(s) made of a material having a function of collecting microwave are arranged or can be arranged so that localized overheating is prevented to effect uniform heating.

Liquid foods packed in a vessel suitable to heating with a microwave oven have already been well-known, also including their production processes. Such liquid foods of the present invention packed in a vessel for microwave oven heating can be produced in accordance with well-known production processes except for protrusions made of a material having a function of collecting microwave.

The protrusions constituting one of the features of the present invention may be integrally molded with a vessel if possible, or may be appended to liquid foods packed in a vessel when they are put on marketing channels.

As for the liquid foods packed in a vessel according to the present invention, a lid or covering made of a material for blocking microwave is of course disposed on the edge of the vessel for the same reasons and for the same purposes as those described for the first embodiment of the present invention. The lid may be disposed in a state being secured to the cover of the vessel for the liquid foods packed in the vessel, may be integrated with the protrusion (FIG. 3(*a*), or may be appended to the liquid foods packed in a vessel when they are put on marketing channels.

With respect to the object further-mentioned above, the present inventors have made an earnest study for attaining the above-mentioned and other objects regarding production of gelled foods such as Japanese chawanmushi, found, as a result, that honeycomb hollows or like other defects can be prevented easily and uniform heating can be carried out even in a case of using a commercial use microwave oven, by applying microwave oven heating while covering the surface of the liquid raw material filled in a vessel with a material such as a metal foil having a microwave blocking function, and arranging protrusion(s) made of a material having a function of collecting microwave on the central part of the surface area, and have, as has been described above, accomplished on the basis of these findings an aspect of the present invention relating to a method of producing heat-gelled foods from a liquid raw material capable of heat-gelling by microwave oven heating, which comprises conducting the microwave oven heating, with the surface of the liquid raw material being covered with a material having a microwave blocking function, and protrusion(s) made of a material having a function of collecting microwave being arranged like an antenna on the central part of the surface area or in the vicinity thereof, so that localized overheating of the liquid raw material contained in the vessel is prevented and the entire liquid raw material is heated uniformly.

Further, the present inventors have made an earnest study for attaining the foregoing and other objects relating to microwave oven heating for liquid foods such as Japanese sake and milk, found, as a result, that they can be attained by microwave-oven heating the liquid foods contained in a vessel with protrusion(s) made of a material having a function of collecting microwave being disposed relative to the liquid and, if necessary or desired, with a lid made of a material having a function of blocking microwave being disposed on the edge of the vessel, and have, as has been described above, accomplished on the basis of these findings another aspect of the present invention relating to a method of heating liquid foods, which comprises subjecting to microwave-oven heating a liquid food in a vessel that may have a lid made of a material for blocking microwave, if necessary or as desired, on the circumferential edge thereof, with protrusion(s) made of a material having a function of collecting microwave being arranged so that uniform heating can be realized while preventing localized overheating.

Furthermore, the present inventors have also made an earnest study for attaining the foregoing and other objects regarding the heat-cooking of dried instant foods such as instant noodles with a microwave oven, found, as a result, that they can be attained by arranging protrusion(s) made of a material having a function of collecting microwave and disposing, if necessary or as desired, a lid made of a material blocking microwave on the circumferential edge of a vessel, in a case where a dried instant food is placed in the vessel and added with water, and then cooked with a microwave oven, and have, as has been described above, accomplished on the basis of these findings a third aspect of the present invention relating to a method of cooking dried instant foods, which comprises placing a dried instant food together with water in a vessel which may have, if necessary or as desired, a lid made of a material blocking microwave on the circumferential edge thereof and cooking it by heating in a microwave oven, with protrusion(s) made of a material having a function of collecting microwave being arranged so that the content in the vessel can be heated uniformly.

With these backgrounds, the present invention in its fourth aspect concerns heating tools for a microwave oven comprising protrusion(s) made of a material having a function of collecting microwave that can be used upon practicing the methods described above, and, more in particular, protrusion(s) made of a material having a function of collecting microwave, and capable of preventing localized overheating of the contents in a vessel and to be arranged with relation to the contents in the vessel such that the entire contents can be heated uniformly, when a raw material food contained in the vessel is to be cooked with a microwave oven.

Description will now be made more specifically of the aspect of the present invention.

The raw material foods to be heat-cooked by using the heating tool for a microwave oven according to the present invention are referred to herein in a broad meaning, and include generally those suitably referred to as raw material such as a liquid raw material, for example, egg liquid in the method of producing the heat-gelled foods described previously, as well as those merely warmed, for example, Japanese sake and milk in the method of heating liquid foods.

Now, as has been described above, it has been already known that a nail- or conical-form projection made of a metal such as stainless steel, or the like has a function of collecting microwave. It has not yet been known, however, to utilize such a phenomenon for uniform heating of the entire liquid raw material with the use of a microwave oven. The inventors have skillfully solved the problem relating to uniform heating of the entire liquid raw material, by utilizing the phenomenon to prevent localized overheating during preparation of gelled foods by means of heating.

Thus, there is no particular restriction, for example, on the number, material, size, form and the like of the antenna-like protrusions provided that they show the foregoing phenomenon and result in uniform heating, but they are preferably as narrow as possible in order not to deteriorate the form of the gelled product when they are removed. The antenna-like protrusions may be made disposable.

To arrange the projections relative to the liquid raw material contained in a vessel, there is no particular restriction on the arrangement provided that they are arranged such that the liquid raw material is heated uniformly. In this connection, as has been described above, "heating uniformly" used in connection with the present invention has a concept including a case in which heating is applied substantially uniformly, as well as all other cases in which heating becomes any more uniform than when applied under the same conditions except for using the protrusions.

The projections of the material having the function of collecting microwave may be arranged as follows, for the purpose of the arrangement. That is, such antenna-like projection(s) are arranged at the central part of the liquid raw material surface or the vicinity thereof, namely, that part which is more difficult to be heated as compared with the outer peripheral part. In order to carry out such arrangement, the protrusion(s) are, for example, arranged relative to the surface of the liquid raw material in such a way that the tip(s) of the protrusion(s) are dipped in the liquid raw material at the central part of the liquid raw material surface or the vicinity thereof. The tip(s) of the projection(s) need not be necessarily dipped in the raw material provided that the similar effect may be obtained, and they may be in contact with, or floated to some extent over, the surface. Moreover, the projection(s) to be arranged like an antenna may, for example, be arranged upward from the bottom of the vessel. See FIG. 2(*b*). In this case, the tips of the projections may be dipped in the raw material or projected from the raw material surface. Also, the projection(s) can be arranged from the inside wall of the vessel into the central part depending on the case (see FIG. 1(*e*)). In short, it may suffice that the tip(s) of the antenna-like protrusion(s) be arranged at a position in which the liquid raw material is difficult to be heated.

Additionally, as has been described above, a cover to block microwave and a projection having the function to collect microwave are used for preventing localized overheating of the raw material contained in the vessel and heating the entire liquid raw material uniformly. From such viewpoints, the projection(s) to be arranged like an antenna are suitably arranged, concretely, for example, as below.

That is, as to the way of arrangement, they are firstly arranged while bound to a cover made of a firstly arranged while bound to a cover made of a metal foil as shown in FIG. 1(*a*). For this purpose, a cover of metallic foil and a projection may be made by integral molding, or the protrusion may be bonded to the cover of metallic foil by means of soldering or suitable adhesives. The projection may be arranged at a suitable position by covering the surface of the liquid raw material with the cover. Moreover, a projection may be arranged separately from a cover of metallic foil as shown in FIG. 1(*b*)–(*f*) and FIG. 2(*a*)–(*b*). FIG. 1(*b*) shows an embodiment wherein a projection is adhered at a right angle to a bar-shaped support chip made of any suitable material and the protrusion is arranged in a suitable position by hanging the support chip on the edge of the vessel in such a way that the tip of the projection is dipped in the liquid raw material. FIG. 1(*c*) shows such a state arranged in this way. FIG. 1(*d*) shows an embodiment wherein a projection of a reversed triangle form is adhered to a support chip. FIG. 1(*e*) shows an embodiment of such a structure in which the tip of the support chip can be hung on the edge of a vessel (the left end of the support chip is made to place the edge of the vessel therebetween), and the projection is arranged from the side wall of the vessel toward the central part of the liquid raw material. FIG. 1(*f*) shows an embodiment of the support chip wherein two bars are crossed to form a support chip, and three projections are adhered to the support chip. FIG. 2(*a*) shows an embodiment wherein the support chip is in a spiral form. FIG. 2(*b*) shows an embodiment wherein (three) projections are arranged upward from the bottom of a vessel. In these cases, the support chip and the projection(s) can of course be made by integral molding depending on the materials.

The above description has been made, bearing in mind a case where heat-gelled foods are produced from the liquid raw material, but it will be obvious to those skilled in the art that this description is applicable as it is also to a case where liquid foods are heated, with the proviso that the liquid raw material is merely replaced with the liquid foods in such explanation.

Accordingly, the protrusions shown in FIG. 1(*a*)–(*f*) and FIG. 2(*a*)–(*b*) can of course be used as they are also in a case of heating liquid foods. However, if the protrusion is fabricated into a shape of a spoon (refer to FIG. 2(*c*) or a stirrer, it is convenient since the protrusion can be used as it is for the stirring of the liquid foods after microwave oven heating.

Further, it can be of such a structure, for example, as shown in FIG. 3(*a*), integrated with a lid covering the edge of the vessel to prevent deposition of heat-coagulated products on the vessel wall due to overheating. FIG. 3(*b*) shows a state in which the integrated lid is arranged on the edge of the vessel with the tip of the protrusion being dipped.

It will be obvious to those skilled in art that the description just made is applicable also to a case where dried instant foods are cooked, with the proviso that the liquid food is merely replaced with dried instant foods added with water in the above explanation for the case of heating the liquid foods. However, it will be convenient to fabricate the protrusion in the shape of a fork (refer to FIG. 2(*d*)), spoon or stirrer since it can be used as it is when taking, drinking or stirring the foods after cooking by microwave oven heating, as a fork, spoon or stirrer.

Further, it is convenient for use to fabricate the shape of a protrusion into an antenna-like form indicating the penetration depth in the liquid contents in a vessel as shown in FIG. 4. FIG. 4(*a*)–(*c*) schematically show that the protrusions may be preferably dipped into the depth shown by an arrow, and FIG. 4(*d*) shows a modification of the protrusion shown in FIG. 1(*e*), which also schematically shows that the protrusion is preferably dipped into the liquid also to a depth shown by the arrow.

Figure 5A:
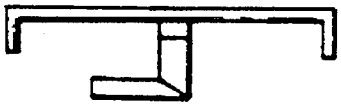
Figure 5B:
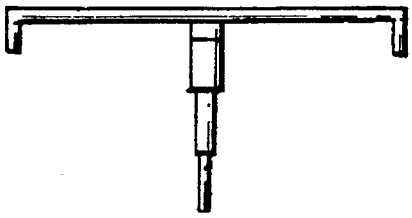

Furthermore, considering the accommodating performance of protrusions, it is possible to make the protrusion into a baton-like structure which is made short by being contained in a sheath when it is not used and extended upon use, and can be contained in a folded state. FIG. 5(*a*) shows a state upon containment and FIG. 5(*b*) shows a state during use.

Figure 6:
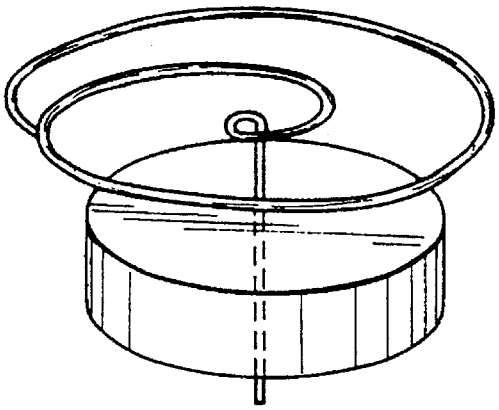

A protrusion of the shape shown in FIG. 2(*a*) can be used by placing the support chip directly on the open edge of a vessel, but can also be used with the protrusion penetrating the cover or lid made of, e.g., aluminum foil, and the support chip being placed on the cover or lid, as shown in FIG. 6.

By the way, reference will be made again to the cover or the lid mentioned previously.

First, regarding the case where gelled foods are produced by using a microwave oven, the cover may be made of any material provided that it has the effect of blocking microwave, for example, metallic foils, such as aluminum foil and stainless steel foil. That is, the shape is not necessarily a so-called foil form but it may be a so-called plate or like other form, as well as its material is not restricted only to metal provided that it has a similar effect. It is used for covering the surface of the liquid raw material to block microwave from above to some extent, whereby honeycomb hollows and the like are prevented from being formed on the surface of the liquid raw material, which may be otherwise caused by localized overheating of the liquid raw material surface layer.

As to the design of the cover to develop the above-mentioned action effectively, the effect can be obtained, for example, by covering the entire opening of the vessel in a case of a steaming cup, but a more preferred effect can be obtained by the design to cover the outer side wall part of the vessel from the top up to a position equal with or slightly above the position of the liquid surface. In this case, holes may be disposed through the cover for the opening. Such cover made of metallic foil or the like may be made disposable.

Further, regarding the case where liquid foods are heated with a microwave oven, a lid made of a material blocking microwave is disposed on the edge of the vessel in order to prevent deposition of heat-coagulated products on the vessel wall caused by localized overheating, more easily and more completely, which is observed upon heating such proteinous liquid foods as milk in a microwave oven.

Quite the same as in the case described previously, the lid can be made of any material provided that it has a function of blocking microwave, including metallic foils such as aluminum foil, stainless steel foil and the like. Further, if a semi-transparent metallic foil or the like having fine apertures disposed therethrough but not permeating microwave is used, the contents can be easily checked from the outside of the lid. The lid may be of any shape provided that it covers the edge of the vessel to prevent deposition of the heat-coagulated products caused by overheating on the vessel wall. Since there is no particular limit to the shape of the lid and it may suffice to be a shape of covering at least the peripheral portion, the central portion may or may not be opened.

Furthermore, regarding the case where dried instant foods are cooked with a microwave oven, as has been described above, if the dried instant foods are those containing a proteinous ingredient, such as skim milk, it tends to cause formation of heat-coagulated protein membrane on the surface of the liquid contents or deposition of the contents on the portion in contact with the vessel wall when such foods are heated with water. In order to prevent such a disadvantage, a lid made of a material blocking the microwave is disposed on the edge of the vessel.

Again, quite the same as in the case described above, any material may be used for the lid provided that it has a function of blocking microwave, including metallic foils such as aluminum foil, stainless steel foil and the like.

Further, if a semi-transparent metallic foil or the like having fine apertures formed therethrough but not permeating the microwave is used, the contents can similarly be confirmed easily from the outside of the lid. The lid may be of any shape provided that it covers the edge of the vessel to prevent deposition of the heat-coagulated products caused by overheating on the vessel wall. Since there is no limit to the shape of the lid and it may suffice to be a shape of covering at least the peripheral portion, the central portion may or may not be opened, as described above.

Then, one of practical modes of such a cover or lid most convenient to use is a heating tool for a microwave oven, in the form of an annular sheet in which the sheet portion is made of a flexible net made of a material having an effect of blocking microwave, and having an elastic member made of, e.g., rubber disposed on the outer circumferential edge thereof in a manner of shortening the length of the outer circumferential edge in its free state (flexible cap).

Figure 7A:
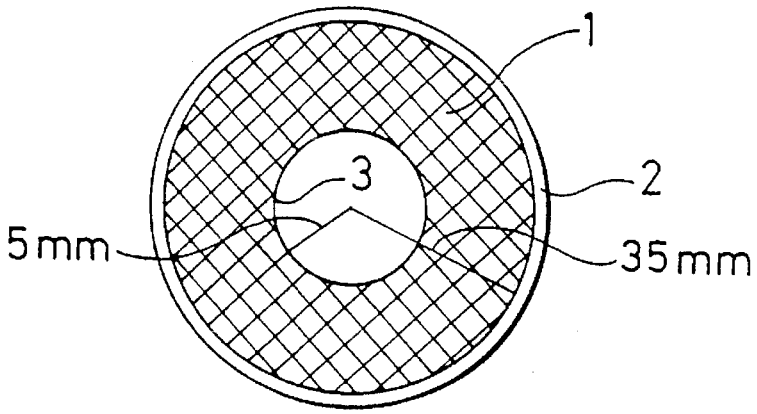
Figure 7B:
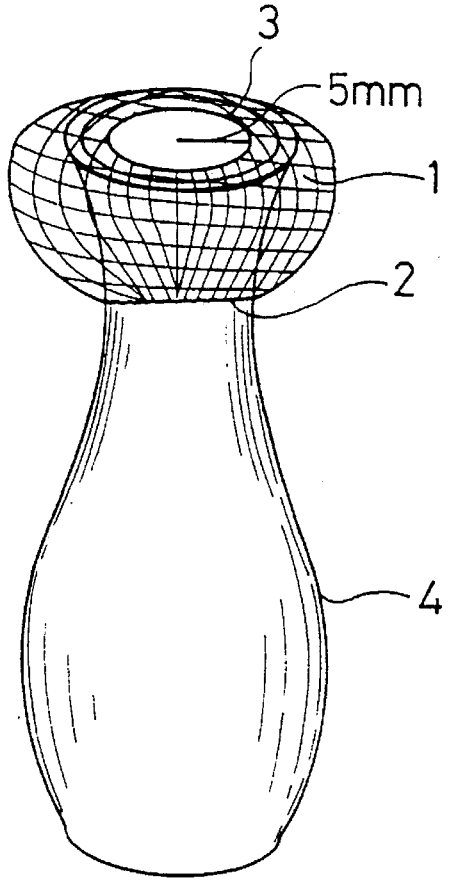

Such a flexible cap is illustrated in FIG. 7 and will be explained.

FIG. 7(*a*) is a perspective view of a flexible cap in an extended state. 1 denotes a flexible net made of a material having a function of blocking microwave (for example, a metal net coated with a heat resistant resin). 2 denotes an elastic member made of, e.g., a rubber frame that shortens the length of the outer circumferential edge of the annular sheet in its free state. 3 denotes an inner circumferential edge of the annular sheet, which may of course be made in such a structure as having a shape retainability as necessary.

FIG. 7(*b*) shows a state where the flexible cap is used, namely, the flexible cap is disposed on the edge of the vessel upon microwave oven heating. 4 denotes a vessel (for instance, Japanese sake warming bottle). When a user puts the flexible cap on the opening of the vessel and releases his fingers, the elastic member at the outer circumferential edge of the annular sheet shrinks to put the vessel outer wall therebetween, by which the annular sheet is secured to the vessel.

A vessel used in a case of producing heat-gelled foods using a microwave oven is, for example, a steaming cup, a vessel used for heating liquid foods is, for example, a milk cup or sake bottle and a vessel use for dried instant foods, is, for example, a cup for cup noodle or cup soup. Since any of such vessels has a circular opening and a cylindrical entire shape, the shape of the flexible cap of the present invention is also made into an annular sheet form so that it can be easily fitted to these vessels. It will be apparent that the diameter of the inner circumferential edge (diameter of the inner circle) of the annular sheet is not greater than the diameter of the opening of the vessel.

The protrusion made of material having a function of collecting microwave according to the present invention can be used in combination with such a flexible cap upon heating with a microwave oven, as well as it may be used alone not in combination with the flexible cap so long as this causes no substantial troubles.

A protrusion of the present invention can be combined with such a flexible cup as a set and put on the market as a heating tool for a microwave oven, or it may be put alone on the market. Further, it may be disposed on the vessel of vessel-contained instant foods or added to vessel-contained instant foods and put on the market.

Another practical mode of the above-explained cover or lid convenient to use is a heating tool for a microwave oven, composed of a set of a plurality of annular or circular sheets of identical or different size made of a material having a function of blocking microwave.

Such a sheet of the heating tool for a microwave oven may, for example, be a metallic foil or net as has been explained previously.

The shape of such a sheet is made either circular or annular because there may be such a situation where the cover or the lid may cover the entire surface of the opening of a vessel, or the central portion may be opened so long as the peripheral portion is covered.

Figure 8A:
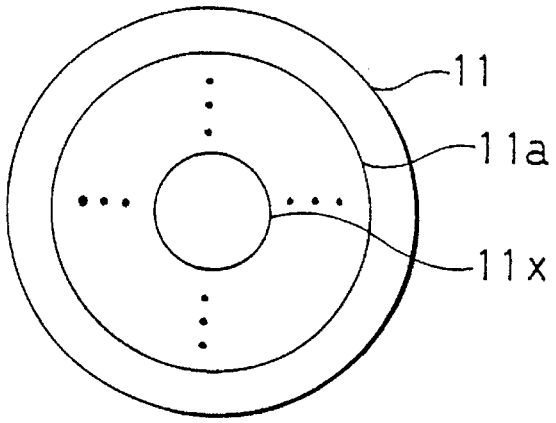
Figure 8B:
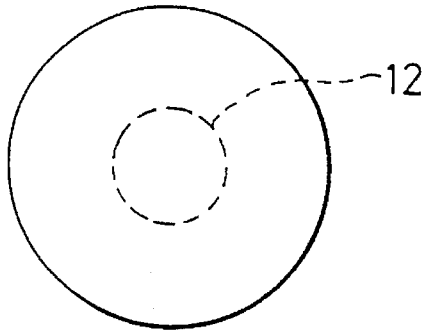
Figure 8C:
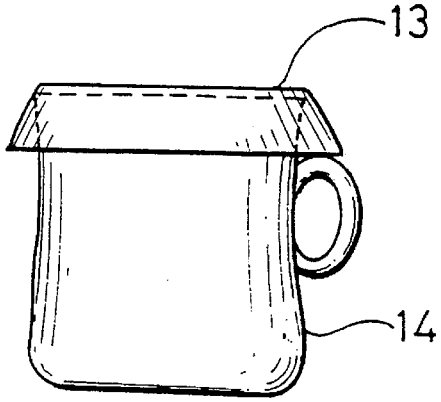

Such a heating tool for a microwave oven is illustrated in FIG. 8 and explained. FIG. 8(*a*) denotes a set of a plurality of circular sheets 11, 11*a*, . . . 11*x* made of a foil or a net of different size and made of a material having the function of blocking microwave. It will be convenient for arrangement to indicate a measure for a fold to the circular sheet upon arranging it on the opening of a vessel when heating is applied by using a microwave oven. FIG. 8(*b*) shows such a state where the measure for the fold (12) is indicated. FIG. 8(*c*) shows a state of the circular sheet (13) arranged on the vessel (14) such as a cup, namely, fitted under folding.

The protrusions of material having a function of collecting microwaves of the present invention can of course be used in combination with such an annular or circular sheet, or it may be used alone not in combination with the sheet so long as this results in no substantial troubles upon heating with a microwave oven in the same manner as the flexible cap. Accordingly, such a set of sheets can be put on the market being combined with the protrusions as a set, or it can be put on the market alone.

Since an end user purchasing the set of such annular or circular sheets on the market can conveniently select and use a sheet of a size suitable to the size of the vessel upon heating by using a microwave oven, it is advantageous.

EXAMPLES

This invention is further illustrated by the following Comparative Examples and Examples.

Comparative Example 1(without metallic foil)

Whole egg, seasoning liquid and ingredients (kamaboka, shrimp and chicken) were used as raw materials to prepare egg liquid for chawanmushi. It was delivered in about 70 ml portions into four 120 ml porcelain steaming cups with lids, respectively.

These four steaming cups in which the egg liquids was poured were covered with lids, and arranged in a commercial use microwave oven of 1400 W output, and its switch was put on.

Figure 9:
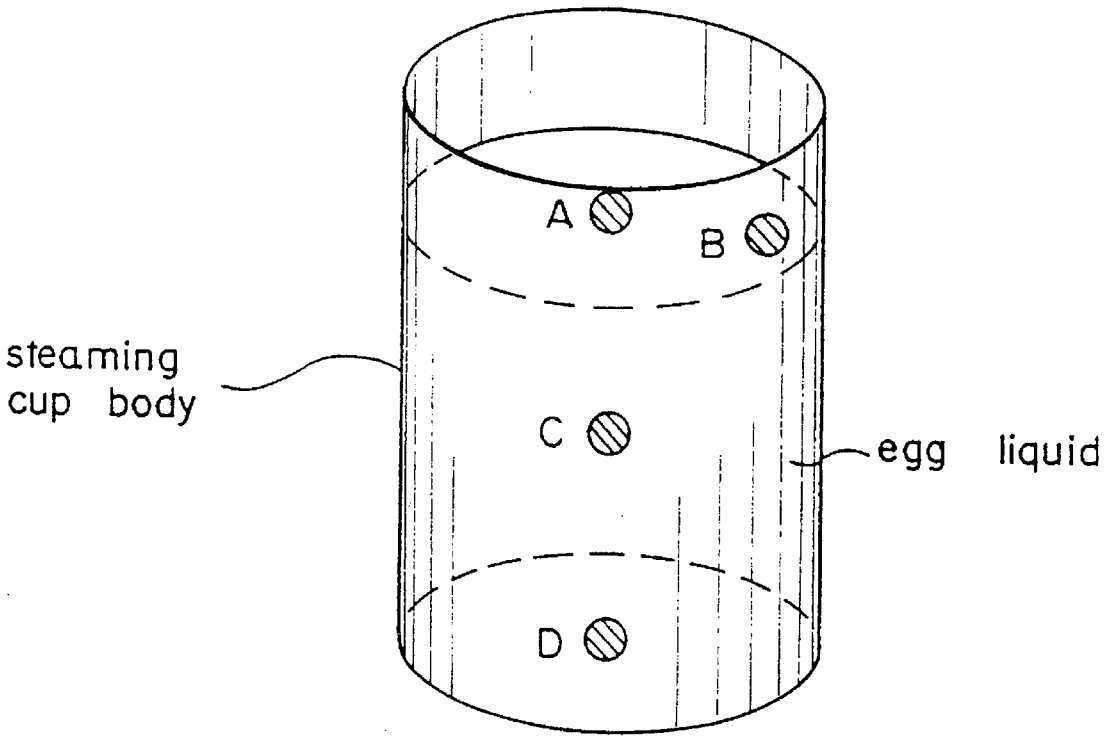
FIG. 9 shows the parts where the temperature was measured. See Comparative Example 1.

The relationship between irradiation time (seconds) and temperature change in a few parts of the egg liquid were followed. Herein, the some parts of the egg liquid were four parts, namely, the central surface of the egg liquid, around the surface (the part along with the inner wall of the steaming cup), the central part of the whole, and the bottom (the part in contact with the bottom of the steaming cup). See FIG. 9. In this FIG. A, B, C and D stand for the above-mentioned relevant parts conceptionally in the above-mentioned order, respectively.

Figure 10:
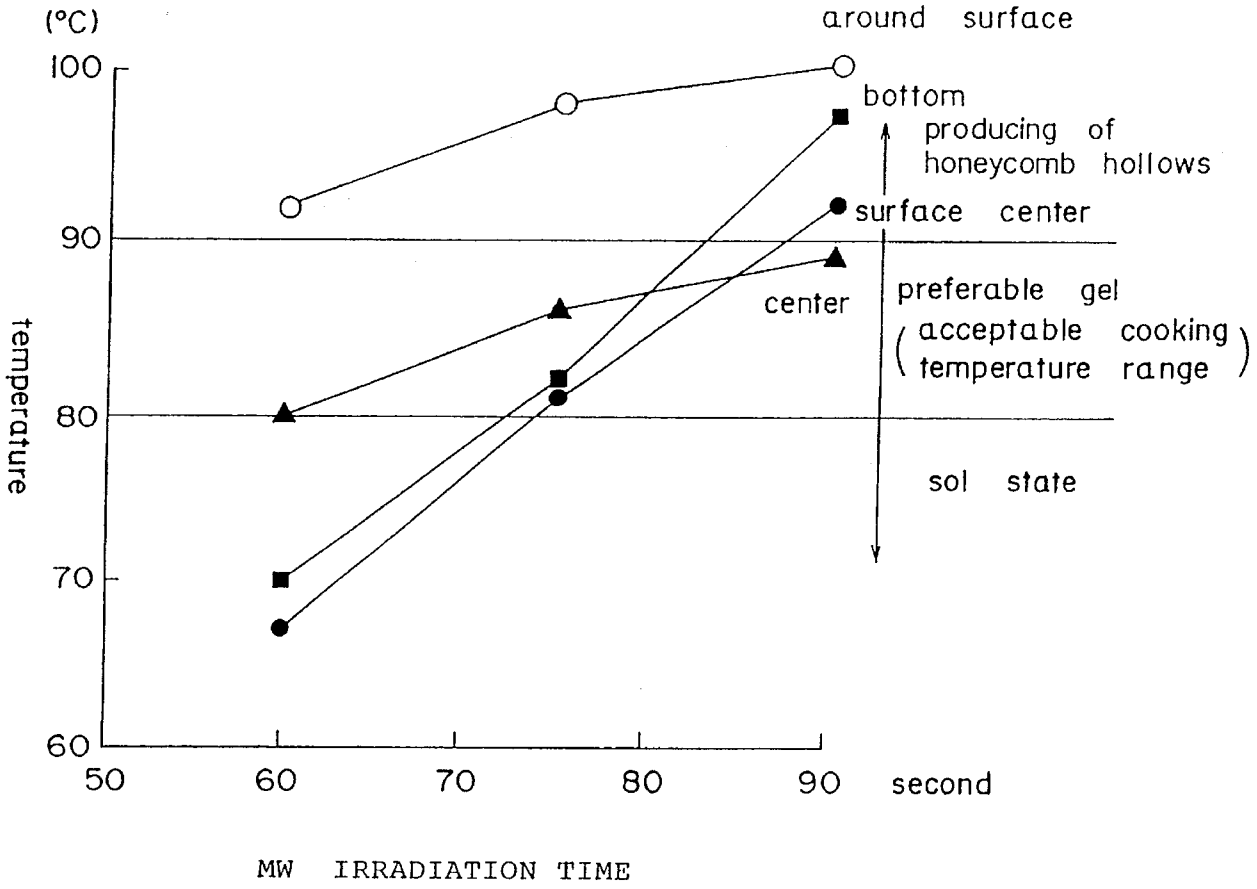
FIG. 10 shows the results in Comp. Example 1.

The results relating to one steaming cup are shown in FIG. 10. As seen from FIG. 10, in this case, all the four concerned parts were not entered in an acceptable cooking temperature range at the same time, and remarkable honeycomb hollows were already produced on the surface of the egg liquid by localized heating after MW irradiation for about 75 seconds.

Comparative Example 2 (with metallic foil and without projection)

Microwave heating was carried out analogously to Comparative Example 1, except that aluminum foil with a thickness of 0.2 mm was used to cover the whole opening and the outer side wall the steaming cup down to 0.5 mm above the liquid surface.

Figure 11:
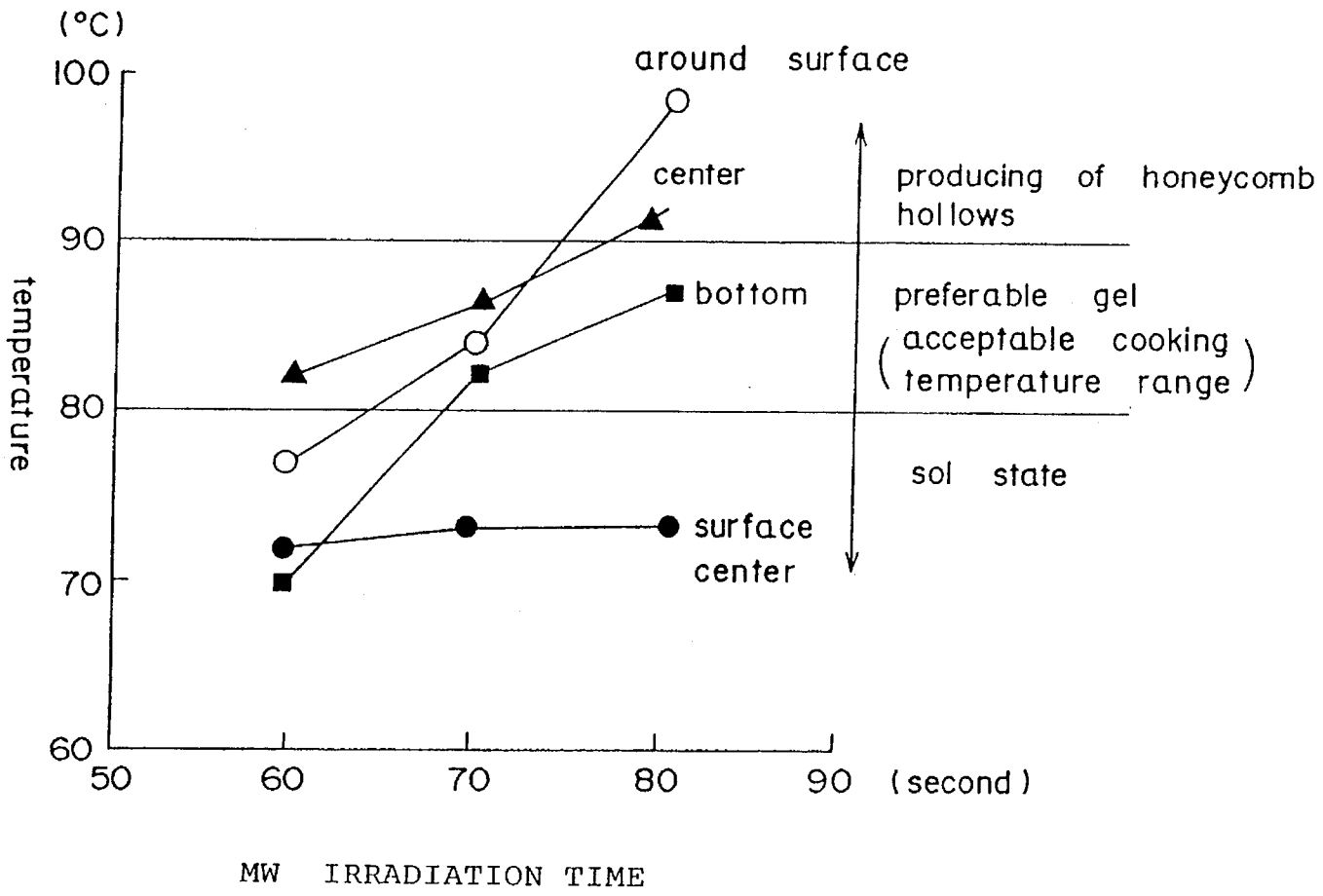
FIG. 11 shows the results in Comp. Example 2.

The following relationship between temperature change of the relevant egg liquid parts and MW irradiation time are shown in FIG. 11. As seen from FIG. 11, in this case, uniform heating was not obtained by using only the inner lid of aluminum, and even if the surface central temperature did not reach the acceptable cooking temperature range, the temperature around the surface had become overheated in 80 seconds, and honeycomb hollows had been produced. The same aluminum foil but with a hole of 3 mm diameter at the central part, gave the similar results.

Example 1(with metallic foil and projection)

Microwave heating was carried out analogously to Comparative Example 2, except that an aluminum foil inner lid equipped with a projection shown in FIG. 1 (*a*) was used in place of the simple aluminum foil inner lid in Comparative Example 2, the projection being a stainless steel metallic chip (its form being a needle one, and size being of 0.2 mm diameter and of 25 mm length), and the chip thereof being dipped in 0.5 mm from the liquid surface.

Figure 12:
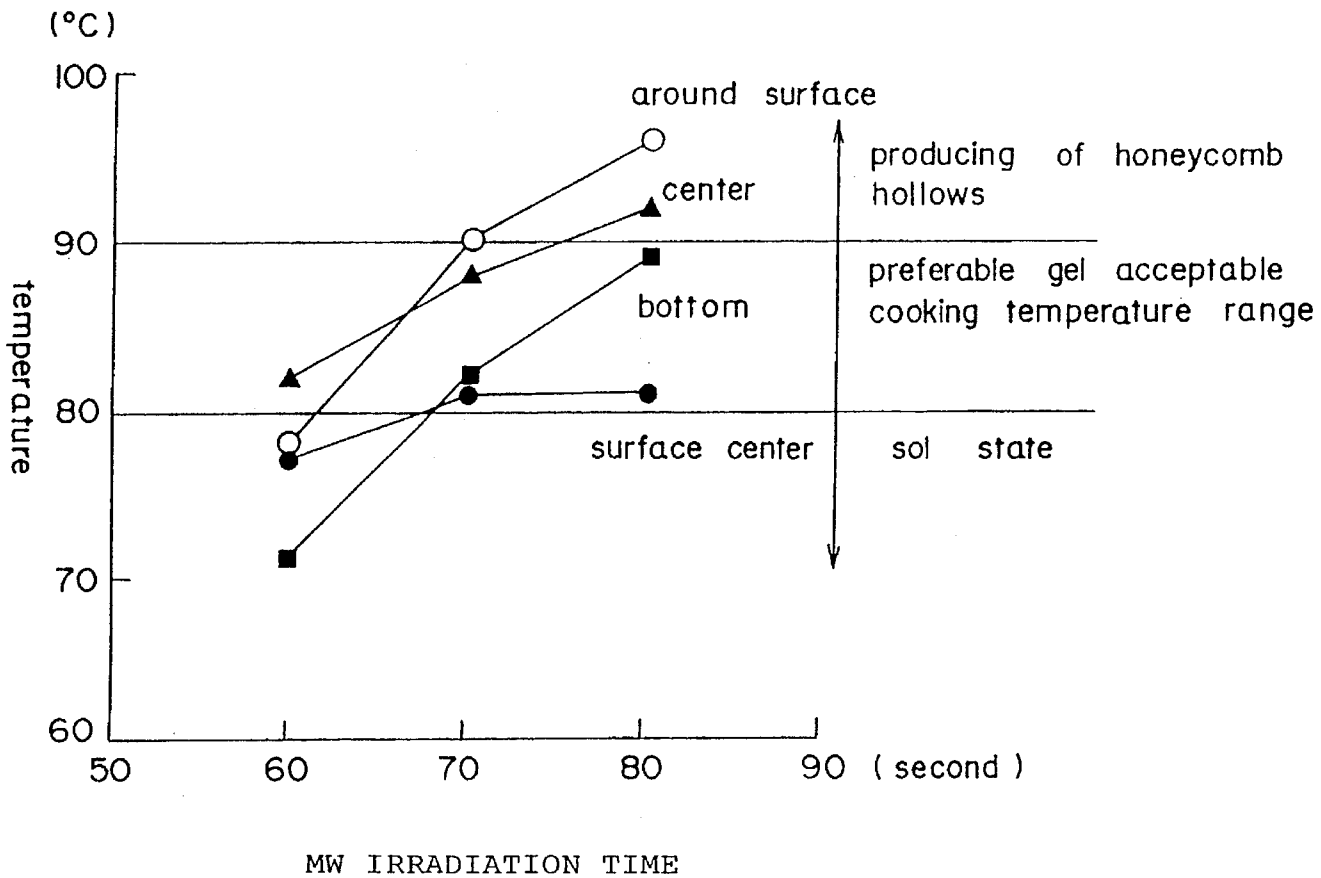
FIG. 12 shows the results in Example 1.

The relationship between temperature change at each part and MW irradiation time followed analogously to Comparative Example 2 are shown in FIG. 12. As seen from FIG. 12, the temperature of all the relevant parts had entered in the acceptable cooking temperature range simultaneously in this case at the irradiation time of about 70 seconds, wherein the inner lid of aluminum foil and antenna-form metallic chip were used, and then there was obtained chawanmushi without any honeycomb hollows. However, honeycomb hollows were produced around the surface in about 80 seconds after continued heating.

In the cases wherein stainless steel projections of the forms shown in FIG. 1(*b*)–(*f*) and FIG. 2(*a*)–(*b*) independent from metallic foil were used in place of the metallic foil with a projection made of material having a function of collecting microwave shown in FIG. 1(*a*), chawanmushi could also be produced without any honeycomb hollows.

Gelled foods of uniformly heat-gelled form including uniform egg processed foods without any honeycomb hollows, above all, are provided by microwave oven heating according to the present invention.

(a) As regards warming of sake;

Comparative Example 3A

Into a sake bottle of 3 cm opening diameter, 6 cm bottom diameter and 19 cm depth, 350 g of sake was poured. It was placed in a commercial use microwave oven with 1400 W output and irradiated with microwave for 60 seconds.

Meanwhile, the temperature distribution was measured at two points, i.e., at the upper part and the bottom part of sake in the sake bottle every 20 seconds. As to the temperature distribution immediately after 60 seconds irradiation, the temperature was 85° C. for the upper part, whereas the temperature was 63° C. for the bottom part, and the temperature difference between them reached as great as 22° C.

When the thus heated (warmed sake was taken, the upper part was warmed under overheating, whereas it was moderate at the bottom part. Scattering of the sake was caused already at that instance by sudden boiling.

When the irradiation time was shortened, although the upper part was in a moderate state, the bottom part was tepid since heating was insufficient.

Thus, warming of sake can not be attained moderate by merely heating in a microwave oven.

Comparative Example 3B

Microwave oven heating was conducted in the same manner as in Comparative Example 3A except for covering the entire opening and the lateral surface as far as 4 cm from the liquid level of a mug cup using an aluminum foil of 0.2 mm thickness as a lid (refer to FIG. 3, but with no protrusion).

As to the temperature distribution immediately after 60 seconds irradiation, the temperature was 64° C. for the upper part but 57° C. for the bottom part.

In this case, the upper part was at a moderate temperature whereas the bottom part was somewhat tepid with insufficient heating upon taking and it can not be said moderate warming.

EXAMPLE 2

A lid of aluminum foil in respect of which an antenna-like small chip was attached to a metal lid as shown in FIG. 1(*b*) used in Comparative Example 3B was employed (refer to FIG. 3). The antenna-like small chip was a stainless steel metal chip of a needle-like shape and sized 0.3 mm diameter, and 100 mm length, and the top end was dipped by 10 cm from the liquid surface. Microwave oven heating was conducted in the same manner as in Comparative Example 3B except for the foregoings.

As to the temperature distribution immediately after 60 seconds irradiation, the temperature was 67° C. for the upper part but 65° C. for the bottom part.

In this case, overheating of the upper part was suppressed while the temperature of the bottom part was increased due to the effect that microwave was collected by the antenna, so that the temperature difference was kept as less as 2° C. and a moderate temperature was obtained upon warming of sake.

Figure 13:
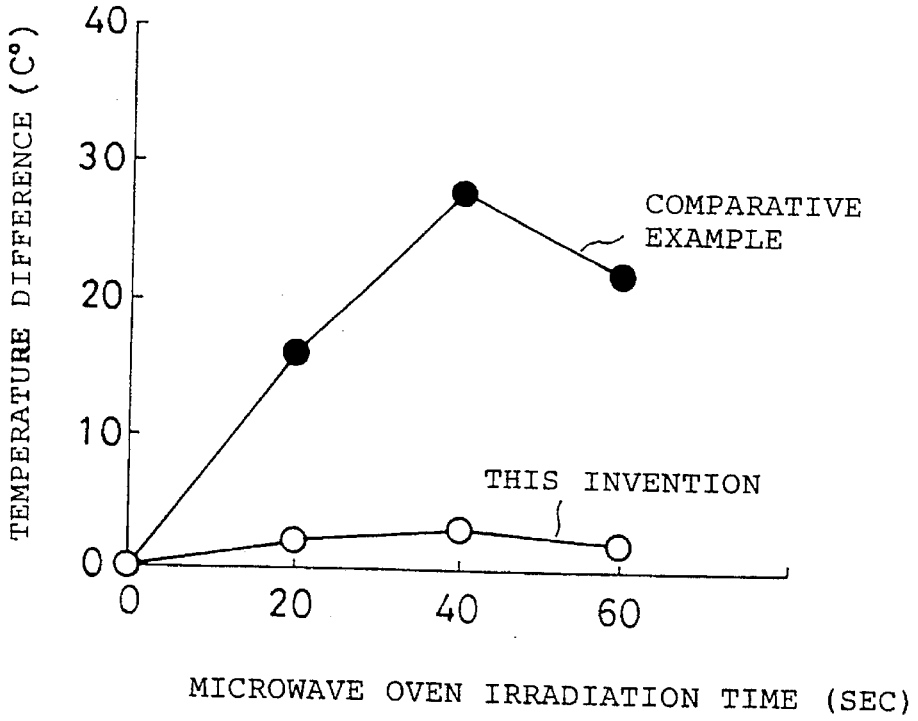
FIG. 13 shows the results in Comp. Example 3A and Example 2.

FIG. 13 shows the result of measurement made every 20 seconds of temperature difference between the upper part and the bottom part during microwave oven heating in a case of not using the metal lid (Comparative Example 3A) and a case of using the metal lid and the antenna-like small chip (Example 2). It can be seen that the temperature difference in the case of using the metal lid and the antenna-like small chip (this invention) is reduced by 15°–30° C. than that of not using the metal lid (Comparative Example).

(b) As regards warming of milk;

Into a mug cup of 7 cm opening diameter and 8 cm depth, 200 g of milk was poured. It was placed in a commercial use microwave oven with 1500 W output and irradiated with microwave for 60 seconds.

Meanwhile, the temperature distribution was measured at two points, i.e., at the upper part and the bottom part of the milk in the mug cup every 20 seconds. As to the temperature distribution immediately after 60 seconds irradiation, the temperature was 93° C. for the upper part, whereas the temperature was 67° C. for the bottom part, and the temperature difference between them reached as great as 26° C.

In this case, the upper part was extremely hot, whereas the bottom part was tepid upon taking since heating was insufficient. Sudden boiling was caused at that instance caused by boiling in the upper part to result in external scattering of the milk and deposition to the cup, which led to a finished state of extremely worsened appearance.

EXAMPLE 3

Microwave oven heating was conducted in the same manner as in Comparative Example 4 except for using a lid made of aluminum foil provided with a small antenna-like chip, the small antenna-like chip being a stainless steel metal chip, having needle shape and being sized 0.3 mm diameter and 40 mm length, and the top end thereof being dipped by 20 mm from the liquid surface.

As to the temperature distribution immediately after 60 seconds irradiation, the temperature was 80° C. for the upper part, whereas the temperature was 71° C. for the bottom part.

In this case, the overheating of the upper part was suppressed, while the temperature of the bottom part was increased due to the effect that the microwave was collected by the antenna, and the temperature difference was kept at 9° C. It was moderate or preferred temperature upon taking.

Figure 14:
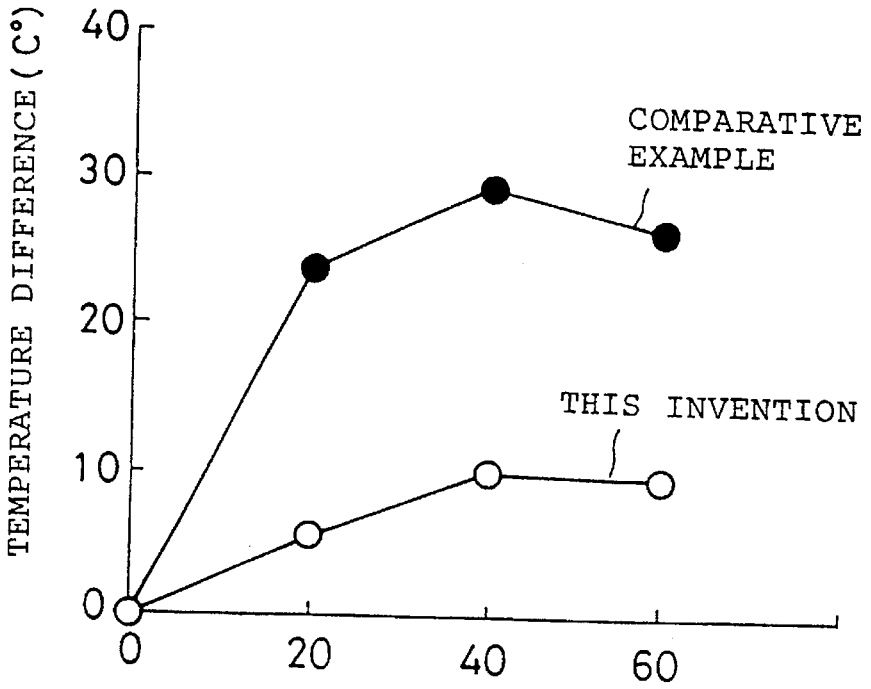
FIG. 14 shows the results in Comp. Example 4 and Example 3.

FIG. 14 shows the result of measurement made every 20 seconds of temperature difference between the upper part and the bottom part during microwave oven heating in Comparative Example 4 and Example 4. It can be seen that the temperature difference in the present invention was reduced by 20°–30° C. as compared with other case.

(c) As regards warming of soup;

Comparative Example 5A

Into a mug cup of 7 cm open diameter and 8 cm depth. 150 g of corn soup was poured. It was placed in a commercial use microwave oven of 1500 W output and irradiated with microwave for 40 seconds.

Meanwhile, the temperature distribution was measured at two points, i.e., at the upper part and the bottom part of the soup in the cup every 20 seconds. As to the temperature distribution immediately after 40 seconds irradiation, the temperature was 91° C. for the upper part, whereas 56° C. for the bottom part.

In this case, the temperature difference between the upper part and the lower part was as great as 35° C., in which the upper part was extremely hot whereas the bottom part was tepid upon taking since heating was insufficient. When heating was continued further, sudden boiling was caused due to boiling in the upper part to result in external scattering of the soup and deposition on the cup to result in a finished state of an extremely worsened appearance.

Comparative Example 5B

Microwave oven heating was conducted in the same manner as in Comparative Example 5A except for covering the entire opening and the lateral surface as far as 1 cm from the liquid level in the mug cup using an aluminum foil of 0.2 mm thickness as a lid.

In this case, the temperature distribution immediately after 40 seconds irradiation showed 80° C. for the upper part and 52° C. for the bottom part, in which overheating of the upper part was suppressed but the temperature difference was as great as 28° C. due to the delay in the temperature elevation at the bottom, and the upper part showed a moderately hot state but the bottom part was in a tepid state since heating was insufficient.

EXAMPLE 4

Microwave oven heating was conducted in the same manner as in Comparative Example 5A except for using a lid made of aluminum foil provided with a small antenna-like chip as shown in FIG. 3, the small antenna-like chip being a stainless steel metal chip, having a needle shape and being sized 0.3 mm diameter and 40 mm length, and the top end thereof being dipped by 20 mm from the liquid surface.

As to the temperature distribution immediately after 60 seconds irradiation, the temperature was 80° C. for the upper part, whereas the temperature was 66° C. for the bottom part.

In this case, the overheating in the upper part was suppressed, while the temperature at the bottom part was increased due to the effect that the microwave was collected by the antenna, and the temperature difference was kept at 14° C. It was at a preferred temperature upon taking.

Figure 15:
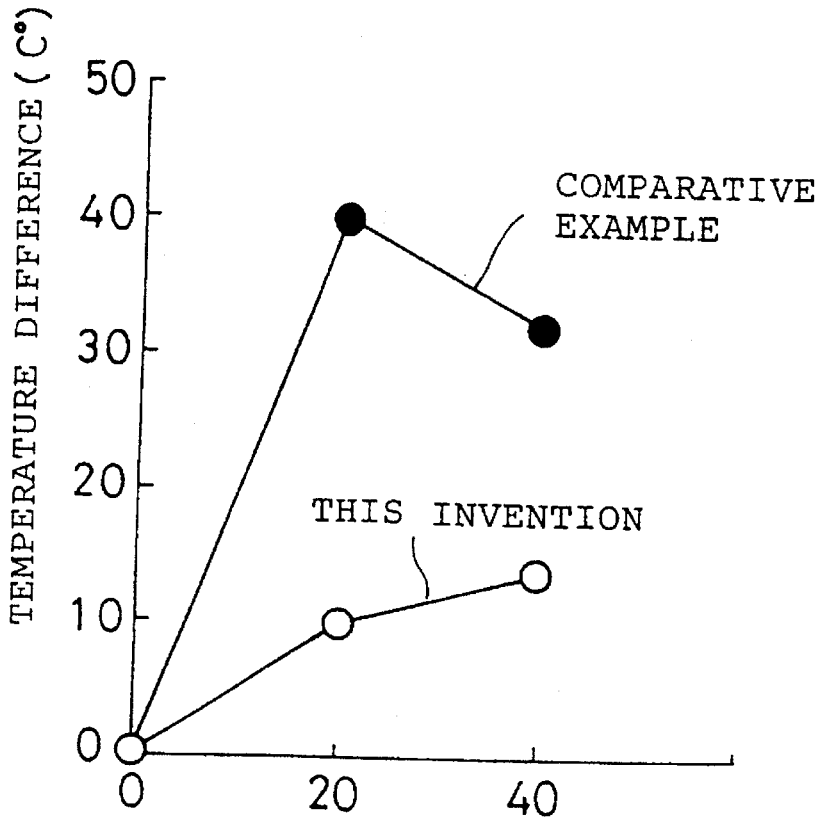
FIG. 15 shows the results in Comp. Example 5A and Example 4.

FIG. 15 shows the result of measurement made every 20 seconds of the temperature difference between the upper part and the bottom part during microwave oven heating in Comparative Example 5A and Example 4. It can be seen that the temperature difference was reduced by 20°–30° C. according to the present invention as compared with other case.

According to the present invention, when the liquid foods are heated with a microwave oven, it is possible to easily heat the liquid foods to a moderate temperature uniformly and effectively while preventing sudden boiling or deposition of heat-coagulated products caused by localized overheating.

Comparative Example 6

60 g of dried noodle and 14 g of ingredient, together with 300 ml of water, were placed in a cup made of foamed polystyrene of 9 cm open diameter, 7 cm bottom diameter and 10.5 cm depth. It was placed in a 500 W domestic use microwave oven and irradiated with microwave for 3 minutes.

During irradiation, the temperature distribution was measured at two points, i.e., in an upper part and a central part of the contents in the cup every one minute and after four minutes.

As to the temperature distribution just after 3 min's irradiation, the temperature was 96° C. for the upper part, whereas 87° C. for the central part. It can be seen from the result that the temperature elevation was slow in the central part and the temperature difference relative to the upper part was as large as 9° C. In addition, the noodles showed poor reversion in such a manner that not-uniformed portion was left upon eating.

Figure 16:
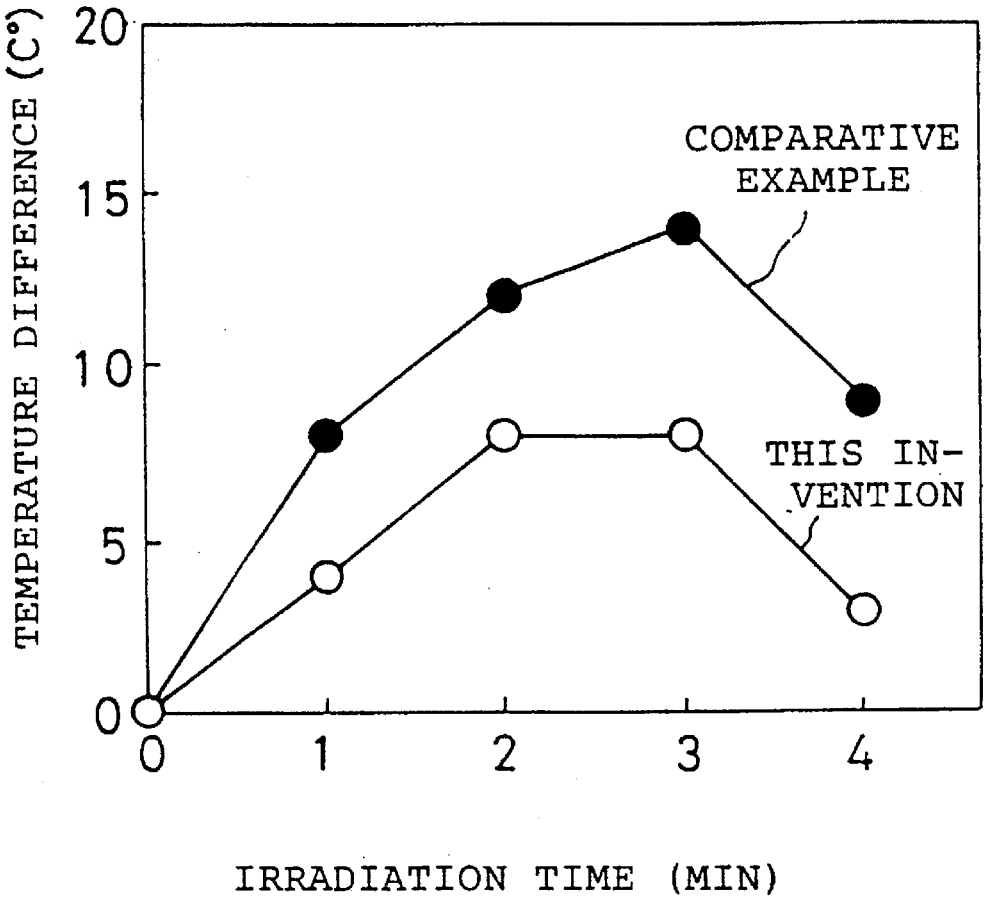
FIG. 16 shows the results in Comp. Example 6 and Example 5.

FIG. 16 shows a temperature unevenness relating to the upper part and the central part.

EXAMPLE 5

The temperature distribution was measured quite in the same manner as in Comparative Example 6, except for putting, over the cup, a metal lid (made of aluminum foil having 3 cm height for a skirt portion) provided with a protrusion made of material having a function of collecting microwave, the protrusion being a metal chip made of stainless steel having 0.5 mm diameter and 55 mm length, with the top of the chip being immersed by 4 cm in the liquid surface of the contents (refer to FIG. 3).

As to the temperature distribution just after 3 min's irradiation, the temperature was 97° C. for the upper part and 93° C. for the central part. In this case, temperature elevation at the central part was promoted by the function of the protrusion to collect the microwave, and the temperature unevenness relative to the upper part was 4° C. Further, as compared with Comparative Example 6, the noodles showed uniform and satisfactory reversion.

FIG. 16 also shows the temperature unevenness between the upper part and the central part.

It can be seen from FIG. 15 that the temperature unevenness caused by microwave oven heating for cup noodles is as less as by 5° C. in the case of the present invention as compared with the comparative example.

According to the present invention, in a case of heat-cooking dried instant foods with addition of water in a microwave oven, uniform heating of the contents in a vessel and effective prevention of deposition of the contents on a vessel wall caused by localized overheating can be prevented easily.

What is claimed is:

1. A method of preparing heat-gelled foods by heating a liquid raw material to be gelled in a microwave oven to gel the liquid raw material, comprising:

placing the liquid raw material in a vessel;

covering the vessel with the liquid raw material placed therein with a cover made of a material having a microwave blocking function, said cover having at least one protrusion made of a material having a function to collect microwaves projecting into the vessel at least in the vicinity of a central part of the vessel; and applying microwaves to the vessel containing the liquid raw material covered by said cover having said protrusion in a microwave oven, whereby the raw material is prevented from being overheated locally and is heated uniformly.

2. A method of cooking dried instant foods contained, together with water, in a vessel, comprising:

arranging at least one protrusion made of a material having a function of collecting microwaves in the vessel; and applying microwaves into said vessel so that the dried instant food together with water contained in the vessel is heated uniformly.

3. A method of cooking dried instant foods as set forth in claim 2, comprising: arranging a lid or cover of the vessel, which lid or cover is made of a material for blocking microwaves, on an edge of the vessel.

4. A method of heating a liquid food, comprising:

placing the liquid food in a vessel;

arranging at least one protrusion made of a material having a function of collecting microwaves in said vessel; and subjecting said vessel with the liquid food placed therein and with the at least one protrusion arranged therein to microwave oven heating so that localized overheating is prevented to effect uniform heating of the liquid food.

5. A method of heating a liquid food as set forth in claim 4, comprising:

arranging a lid or cover of the vessel, which lid or cover is made of a material for blocking microwaves, on an edge of the vessel.

* * * * *